US006073806A

United States Patent [19]

Dekker

[11] Patent Number: 6,073,806

[45] Date of Patent: Jun. 13, 2000

[54] ATTACHMENT FOR EMPTYING A BAG WHICH IS FILLED WITH VISCOUS LIQUID INTO A WORKING CONTAINER

[75] Inventor: Albert Dekker, Giessenburg, Netherlands

[73] Assignee: Vinmar Giessenburg B.V., Netherlands

[21] Appl. No.: 09/274,579

[22] Filed: Mar. 23, 1999

[30] Foreign Application Priority Data

Mar. 25, 1998 [NL] Netherlands ..... 1008693

[51] Int. Cl.[7] ..... B65D 35/28

[52] U.S. Cl. ..... 222/103; 222/93; 222/95; 222/105

[58] Field of Search ..... 222/93, 95, 103, 222/105

[56] References Cited

U.S. PATENT DOCUMENTS

| | | | |
|---|---|---|---|
| 2,037,989 | 4/1936 | Macklanburg | 222/103 |
| 2,197,958 | 4/1940 | Waters | 222/105 |
| 2,638,250 | 5/1953 | Houldsworth | 222/95 |
| 2,795,356 | 6/1957 | Tschumy | 222/95 |
| 2,921,718 | 1/1960 | Meissner | 222/103 |
| 3,248,012 | 4/1966 | Adams | 222/95 |
| 3,430,815 | 3/1969 | Weimer et al. | 222/105 |
| 4,624,394 | 11/1986 | Ushiro | 222/103 |
| 4,778,082 | 10/1988 | Vitelle | 222/95 |
| 4,928,851 | 5/1990 | Eatherly | 222/103 |
| 4,976,380 | 12/1990 | Von Schuckmann | 222/103 |
| 5,035,347 | 7/1991 | Trovó | 222/95 |
| 5,071,036 | 12/1991 | Kelly et al. | 222/103 |
| 5,222,629 | 6/1993 | Tal | 222/103 |
| 5,651,460 | 7/1997 | Foerderer | 206/447 |
| 5,657,903 | 8/1997 | Roberts | 222/95 |
| 6,003,729 | 12/1999 | Berkus | 222/103 |

FOREIGN PATENT DOCUMENTS 42 26 644 A1 2/1994 Germany .

*Primary Examiner*—J. Casimer Jacyna
*Attorney, Agent, or Firm*—Brooks & Kushman P.C.

[57] ABSTRACT

Attachment for emptying a thin plastic bag containing a viscous liquid, especially a bag filled with adhesive. Said attachment comprising a base plate (3), which preferably is designed as a lid, which fits onto the working container. In said base plate an opening (4) is made, which opening has a tapered section (5), which tapers to a point (8). The side edges (6, 7) of said tapered section being connected to one another at said point (8) via a suitable rounded section. At least along said rounded section an upwards projecting wall (9) has been arranged, said wall forming a guiding surface for the thin bag, whereas on the bottom side of the base plate a wall (11) is arranged, said wall forming a screen near the said point (8). The wall (9) and the screen (11) can together with the rounded section be designed as an insert, that can be clamped into the tapered section (5) of the opening (4) of the base plate.

8 Claims, 4 Drawing Sheets

ATTACHMENT FOR EMPTYING A BAG WHICH IS FILLED WITH VISCOUS LIQUID INTO A WORKING CONTAINER

BACKGROUND OF THE INVENTION

The invention relates to an attachment for emptying a bag, which is filled with viscous liquid into a working container.

For companies, which use large quantities of adhesive, disposing of refuse constitutes a considerable problem. This is because the adhesive, which consists of a viscous liquid or pasty substance, is packaged in drum-like plastic containers. In order to prevent the adhesive from drying out, the adhesive in each container is additionally packed in a thin plastic bag. To use the adhesive, the lid is removed from the container and the bag is opened. The adhesive is then poured out of the plastic bag into the container in question. This often results in spillage, so that the outside of the container and/or the user becomes contaminated and adhesive is lost. When the container is empty after the adhesive has been used, it has to be disposed of, together with the residual glue in the container, as chemical waste. The costs of removing and disposing of chemical waste are currently substantial.

SUMMARY OF THE INVENTION

The object of the present invention is therefore to provide an attachment, which can be used efficiently to empty the thin plastic bag, which is filled with viscous liquid or adhesive into a working container, essentially without spillage.

According to the present invention, this object is achieved with the aid of the attachment having a baseplate which is to be positioned on the working container and in which an opening is made which opening has a section which tapers to a point, the side edges of the tapered section which narrow towards one another being connected to one another at the point via a suitable rounded section, an upward projecting wall which delimits at least partly the rounded section at the point of the tapered section and is bent away from the opening being arranged, said wall forming a guiding surface for the thin bag, a wall being arranged on the bottom side of the base plate, which wall forms a screen near the said point.

After it has been opened, the thin plastic bag containing the adhesive is thrown, liquid and all, upside down into a container, which serves as the working container. Usually, an original packaging container will be used as the working container. Then, the attachment is placed on this working container. The bottom of the bag, which is facing upwards, is then taken hold of and pulled through the opening in the attachment. By pulling the plastic bag slightly sideways through the tapered section of the opening, the bag is compressed and the viscous liquid is forced out of the bag, into the working container, by said bag being pulled upwards. As a result, only the cut-open thin plastic bag remains as chemical waste. If the plastic bags containing viscous liquid are always poured into the same working container, the original packaging containers remain clean and can be sent back to the adhesive manufacturer for reuse.

Preferably, according to the invention, the baseplate of the attachment is designed as the lid of the working container.

The invention is explained in more detail with reference to the accompanying drawings.

DETAILED DESCRIPTION OF THE DRAWINGS

Figure 1:
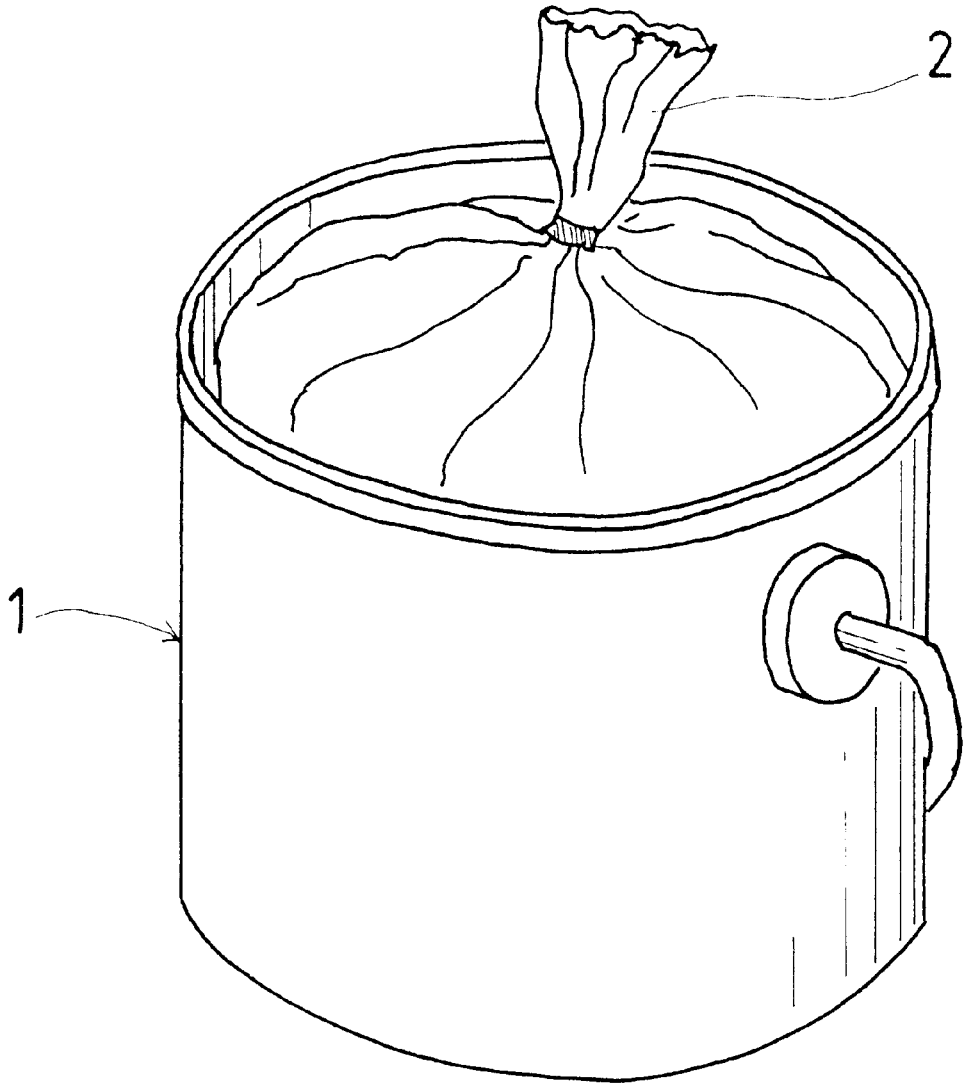
FIG. 1 shows a container with the lid removed, in which a plastic bag filled with a viscous liquid is positioned.

FIG. 1 shows a conventional drum-like container 1 with the lid removed, in which container a plastic bag 2, which is filled with a viscous liquid, such as adhesive for gluing floor covering, is positioned. This is the customary way in which such adhesive is currently packaged. In this case, the purpose of the thin plastic bag 2 is to prevent the adhesive from drying out.

In general, when used, the plastic bag is opened and then emptied into the container 1 which is used as its packaging. The adhesive is used and the empty container, containing residues of adhesive, and the thin plastic bag are disposed of as chemical waste. Thus the use of adhesive packaged in this way has a number of drawbacks. Emptying the thin plastic bag results in spillage, and it is often impossible to empty the thin plastic bag completely, with the result that, on the one hand, adhesive is lost and, on the other hand, the amount of chemical waste increases. The empty containers containing residues of adhesive also form a considerable quantity of chemical waste.

Since the costs of disposing of chemical waste are considerable, the invention proposes an attachment which makes viscous liquid which has been packaged in this way easier to use and can also substantially reduce the amount of chemical waste.

Figure 2:
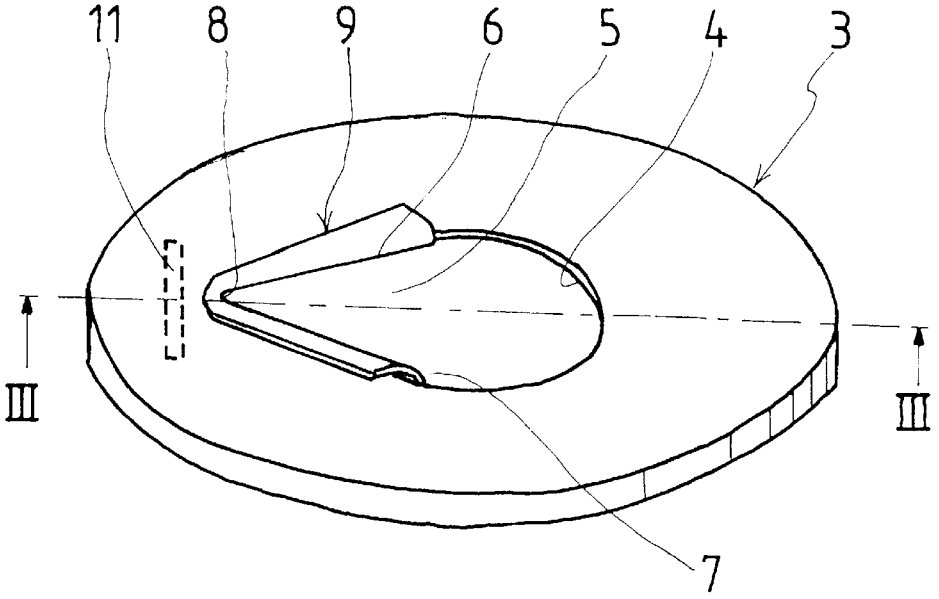
FIG. 2 shows a lid for the container shown in FIG. 1, which lid is designed as an attachment according to the invention.

FIG. 2 shows a perspective view of this attachment. The attachment comprises a planar baseplate 3, which in the exemplary embodiment illustrated is formed as a lid which fits onto the container 1 and has a circumferential edge 3' which projects downwards and, as is customary, is used to attach the lid securely to the container.

An opening 4 which has a tapered section 5 extending in the radial direction is arranged in the baseplate. The convergent side edges 6, 7 of this tapered section run towards one another so as to form a point 8 which is suitably rounded. A projecting wall 9 is arranged along the side edges 6 and 7 of the tapered section, which wall, via the rounded point 8, continues from one side edge to the other. This wall 9 thus delimits the tapered section 5 of the opening and is bent over away from the opening over its entire length. It is preferable for the wall 9 to be bent through 90°, so that this wall defines a upper surface 10 which is essentially parallel to and at a distance from the baseplate.

A wall 11 which is perpendicular to the baseplate is arranged on the bottom side of the baseplate, which wall lies at a certain distance from the point 8 of the tapered section and is directed essentially perpendicular to the bisector of the angle included by the side edges 6, 7 of the tapered section.

Figure 3:
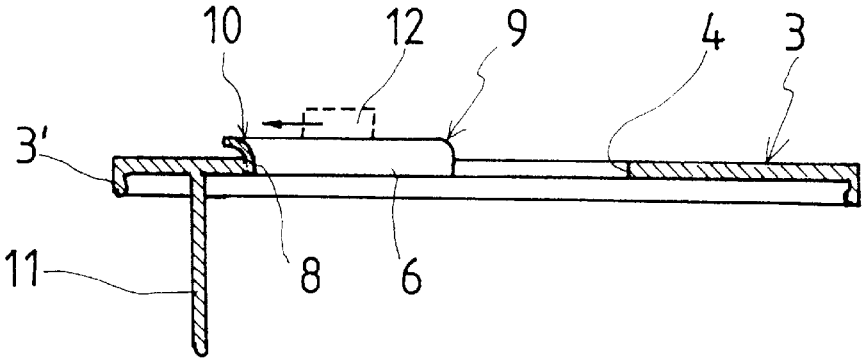
FIG. 3 shows a cross section through the lid shown in FIG. 2, on line III—III in FIG. 2.

The attachment according to the invention functions as follows. The adhesive is supplied in the packaging illustrated in FIG. 1. The thin plastic bag 2 is opened and the open thin bag is thrown upside-down into a container which is identical to the container 1 and functions as a working container. The thin plastic bag therefore now lies with its bottom facing upwards inside the working container. Then, the attachment is placed onto the container. The bottom of the thin plastic bag is taken hold of at one location and is pulled upwards a certain distance through the opening. That section of the plastic bag which projects through the opening is then guided sideways into the tapered section as far as it will go, so that the thin bag is compressed in this section. By then pulling the thin bag further upwards, the bag is emptied into the working container. If appropriate, a spatula 12 (shown in dashed lines in FIG. 3) or the like, which rests on the top face 10 of the wall 9, can be used to press the bag further towards the point 8 of the tapered section 5, in the direction of the arrow, in order to obtain even better compression and consequently better emptying of the bag. In this case, the purpose of the wall 11 is to prevent the viscous liquid which is forced out of the bag from coming into contact with the side wall of the container.

The flanged wall 9, which delimits the tapered section of the opening, forms a guiding surface so that the thin plastic bag can easily be pulled upwards with minimum friction, so that the risk of the bag tearing is minimal.

A particularly substantial reduction in the amount of chemical waste can be obtained, for example, by using a single container which originally served as a packaging container as the working container. This means that the thin plastic bag is always thrown into the same container, which serves as the working container, and is then emptied with the aid of the attachment. The packaging containers thus remain clean and can be sent back to the adhesive manufacturer for reuse.

Figure 4:
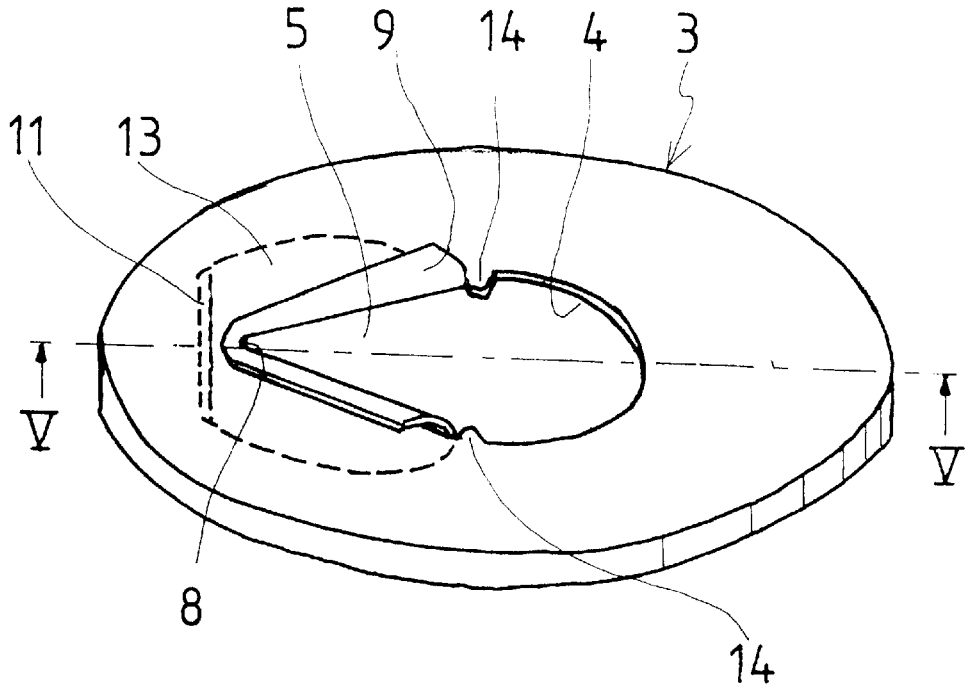
FIG. 4 shows a view corresponding to FIG. 2 of another embodiment of the attachment according to the invention.
Figure 5:
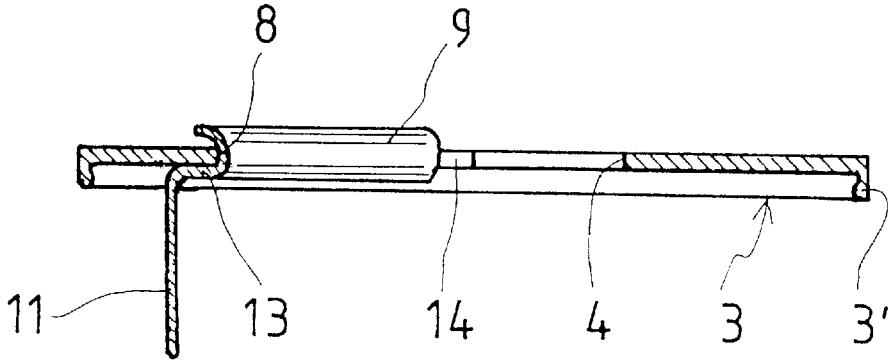
FIG. 5 shows a cross section on line V—V in FIG. 4.

FIGS. 4 and 5 show another embodiment of the attachment, and in these figures identical reference numerals are used for identical or corresponding components. In this embodiment, the projecting wall 9, together with the wall 11 which runs downwards, is designed as a separate insert, forming a single unit, which is clamped into the tapered section 5 of the opening 4.

As can clearly be seen in these figures, the wall 9 continues into a planar section 13 which bears against the underside of the lid 3. The planar section 13 then merges into the wall 11 which is perpendicular thereto. Inwardly facing projections 14, which hold the insert in the fitted position, are arranged at the transition from the opening 4 into the tapered section 5. The insert can be arranged and removed with ease by pressing the ends of the wall 9 which lie opposite one another together slightly, so that this wall can slide past the projections 14.

Figure 6:
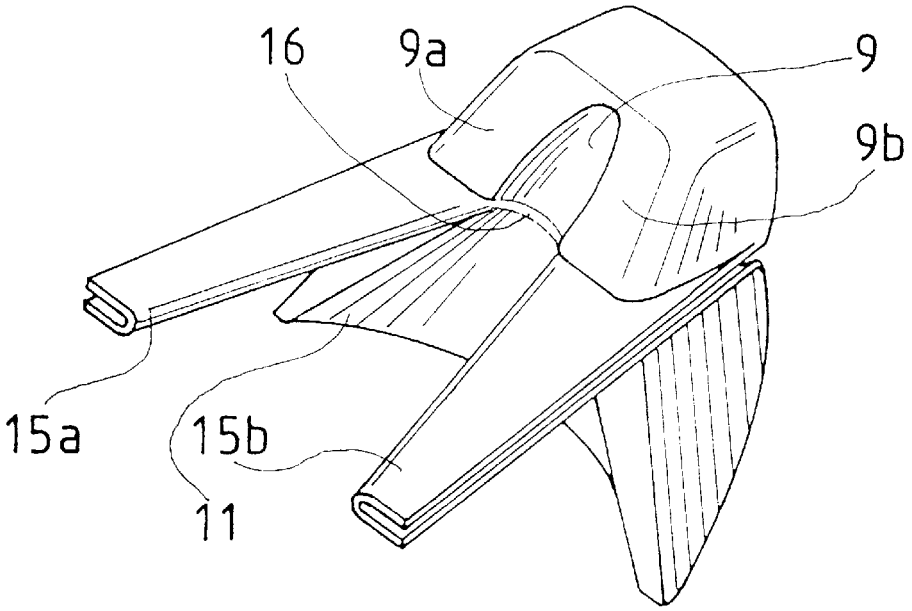
FIG. 6 shows a perspective view of another embodiment of the insert in FIGS. 4 and 5.
Figure 7:
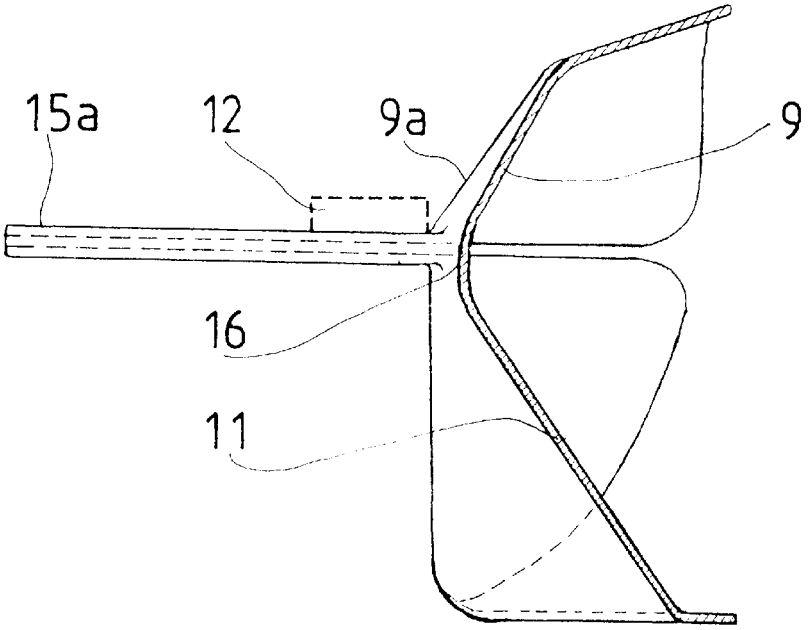
FIG. 7 shows a vertical sectional view of the insert in FIG. 6.

FIG. 6 shows another embodiment of the insert, in which the insert comprises two legs 15*a* and 15*b* each having a U-shaped cross section for engaging the side edges 6, 7 of the tapered section of the opening in the baseplate. Both legs are connected to one another via a rounded portion 16. The wall 11 is designed as a conical surface extending downward from the rounded portion 16 and diverging therefrom. Upward from the rounded portion 16 extends the wall 9, which forms a guiding surface for the plastic bag. The wall 9 extends from the location where the rounded portion merges into the straight legs sidewards and forms abutment faces 9*a* and 9*b*. When the thin plastic bag is pulled upward along the surface 9 the spatula can be pressed against the faces 9*a* and 9*b* for better emptying said bag. FIG. 7 shows clearly the mutual arrangement of the wall 9, the rounded portion 16 and the conical screen 11. A spatula 12 is pressed against the faces 9*a* and 9*b*, which spatula leaves an aperture free between itself and the rounded portion 16. The plastic bag to be emptied will be pulled upwards through said aperture, whereas the screen 11 prevents that the viscous liquid from the bag comes in contact with the side wall of the working container.

It will be clear that the invention is not limited to the embodiments illustrated and described here, but rather a large number of changes and variants are possible within the scope of the appended claims. For example, the baseplate may be of any suitable form and may be fixed to the working container in any suitable way. The shape and extent of the taper of the opening may also vary depending on the viscosity of the liquid in question.

What is claimed is:

1. Attachment for emptying a thin plastic bag containing a viscous liquid into a working container, comprising a baseplate (3) which is to be positioned on the working container and in which an opening (4) is made which opening has a section (5) which tapers to a point (8), the side edges (6, 7) of the tapered section which narrow towards one another being connected to one another at the point via a suitable rounded section, an upwards projecting wall (9) which delimits at least partly the rounded section at the point (8) of the tapered section and is bent away from the opening being arranged, said wall forming a guiding surface for the thin bag, a wall (11) being arranged on the bottom side of the baseplate, which wall forming a screen near the said point (8).

2. Attachment according to claim 1, wherein the baseplate is provided with attachment means (3') for attaching it to the working container.

3. Attachment according to claim 1, wherein the baseplate is designed as a lid which fits onto the working container in question.

4. Attachment according to claim 3, wherein the bottom side wall (11) is curved in a corresponding manner to the circumferential edge of the lid.

5. Attachment according to the claim 1, wherein the upwardly projecting wall (9) extends also along the side edges (6, 7) of the tapered section and is bent over away from the opening through an angle of 90°, so that this wall forms a upper surface (10) which is parallel to and at a distance from the baseplate.

6. Attachment according to the claim 1, wherein upwardly projecting the wall (9) extends only along the rounded section and is bent sidewards away from the opening near the locations where the rounded section merges into the straight side edges (6, 7).

7. Attachment according to claims 6, wherein the upwardly projecting wall (9), together with the bottom side wall (11), is designed as a separate insert (9, 13, 11) which forms a single unit and can be clamped into the tapered section of the opening, in which case projections (14) which extend towards the tapered section (5) are arranged on the side edges (6, 7) at some distance from the point (8) in order to hold the said insert in place.

8. Attachment according to claim 7, wherein the insert comprises two legs (15*a*, 15*b*), each having a U-formed cross section for engaging the said side edges (6, 7) of the tapered section of the opening in the baseplate, said legs merging into each other via a rounded portion (16), the screen (11) being formed as a conical shaped surface extending downward and diverging from said rounded portion and the upwardly projecting wall (9) forming the guiding surface extending upward from said rounded section.

* * * * *